United States Patent [19]

Zanker et al.

[11] Patent Number: 4,603,078

[45] Date of Patent: Jul. 29, 1986

[54] CONSTRUCTION PANEL MADE OF POLYURETHANE INTEGRAL HARD FOAM

[75] Inventors: Helmut Zanker, Wunstorf; Joachim Kleiss, Dettelbach, both of Fed. Rep. of Germany

[73] Assignee: Fulgurit GmbH & Co. Kommanditgesellschaft, Wunstorf, Fed. Rep. of Germany

[21] Appl. No.: 601,531

[22] Filed: Apr. 18, 1984

[30] Foreign Application Priority Data

Apr. 8, 1983 [DE] Fed. Rep. of Germany ..... 3313988
Jan. 18, 1984 [DE] Fed. Rep. of Germany ..... 3401509

[51] Int. Cl.[4] ..... B32B 3/26

[52] U.S. Cl. ..... 428/317.9; 428/318.6; 428/318.8; 428/319.3; 521/51; 521/906

[58] Field of Search ..... 521/51, 906; 428/314.4, 428/314.8, 317.9, 318.6, 318.8, 319.3

[56] References Cited

U.S. PATENT DOCUMENTS

| | | | |
|---|---|---|---|
| 3,775,350 | 11/1973 | Juhas | 428/318.8 |
| 4,042,536 | 8/1977 | Dieterich et al. | 521/906 |
| 4,209,564 | 6/1980 | Nomura et al. | 428/318.8 |
| 4,232,085 | 11/1980 | Carlstrom et al. | 428/318.8 |
| 4,349,494 | 9/1982 | Fulmer et al. | 521/906 |
| 4,499,038 | 2/1985 | Schäfer et al. | 521/51 |

OTHER PUBLICATIONS

Anwendungstechnische Beratung Knapsack-Exolit 422, Hoechst, No Date, 1 page.
Industrielacke, DD-Härterzusatz Lichtecht, Schwaabetan, Nov. 1980, 2 pages.
Industrielacke, DD-Kunststofflack, Schwaabetan, Apr. 1981, 2 pages.
Desmophen-Versuchsprodukt PU1134, Bayer, Jun. 1977, 10 pages.
Lackierung Von Polyurethanschaumstoffen Mit Desmodur/Desmophen Lacken-DD Lack, Bayer, Jun. 1975, 4 pages.
Desmodur 44 V20B, Bayer, Oct. 1980, 2 pages.
Phosphorprodukte-Exolit 263, Hoechst, Sep. 1976, 1 page.

*Primary Examiner*—William J. Van Balen
*Attorney, Agent, or Firm*—Wells & Wells

[57] ABSTRACT

A polyurethane integral hard foam construction panel comprises a denser edge zone and a porous core, the surface of the construction panel being enameled, and is used as a roofing plate, in particular as a small format, nailed roof cover plate.

For that purpose the invention provides that the polyurethane integral hard foam of the construction panel includes fillers, namely 1 to 65% by weight flame-retardants such as aluminum hydroxide [$Al(OH)_3$] and/or Exolite and 1 to 90% slate powder.

18 Claims, 1 Drawing Figure

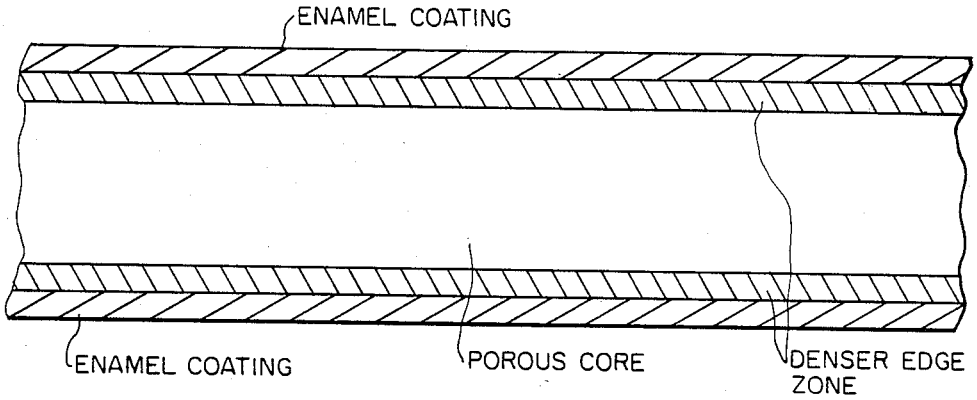
ENAMEL COATING
ENAMEL COATING
POROUS CORE
DENSER EDGE ZONE

CONSTRUCTION PANEL MADE OF POLYURETHANE INTEGRAL HARD FOAM

BACKGROUND OF THE INVENTION

The invention concerns a construction panel consisting of polyurethane integral hard foam and comprising a high density edge zone and a porous core, the panel surface being enameled.

Known construction panels of this kind include among their applications the use of breast panels of windows, that is, they replace part of the window pane in the lower part of the window frame.

SUMMARY OF THE INVENTION

The object of the invention is to so design a construction panel of the initially cited kind that it can be used as a roofing panel, in particular as a small format nailed roofing plate.

This problem is solved by the invention by the polyurethane integral hard foam of the construction panel being provided with fillers, namely with 5 to 65% by weight of flame-resistant agents such as aluminum hydroxide [$Al(OH)_3$] and/or 5 to 25% by weight Exolite (ammonium polyphosphate) and 30 to 90% by weight of slate powder having a wide granulometric range.

BRIEF DESCRIPTION OF THE DRAWING

Appended hereto is a drawing showing the construction panel of the present invention made of polyurethane integral hard foam having fillers in the porous core, a denser edge zone and enameled panel surfaces.

DESCRIPTION OF THE PREFERRED EMBODIMENTS

Exolite is ammonium polyphosphate. ®Exolite 263 is avaiable from Hoeschst and ®Exolite 422 is available from Knapsak.

Such a construction panel offers a more than trivial reduction in costs compared to known panels and furthermore a substantial improvement regarding combustibility and, accordingly such panels are also applicable as roofing plates. The construction panel of the invention is especially resistant to flue fire and radiated heat and even makes possible achieving the low flammability of combustion class B1. This improvement in the properties of a polyurethane foam panel makes it possible for the first time to use such construction panels as roofing plates. It was discovered, in a surprising manner, that the already indicated small amounts of the fire-retardant agents induce a substantial improvement in the flammability of the construction panel provided the proportion of the remaining fillers is relatively high.

Another advantage of the construction panel of the invention is that the thermal coefficient of expansion is substantially reduced by using the fillers within the ranges indicated above and therefore no disadvantageous displacements of or relative motions between the construction panels and the roof take place for all weather conditions incurred in practice, in particular weather-caused temperature changes.

Despite the fillers being used within the above-indicated ranges it was furthermore surprisingly found that the damping properties of such a polyurethane foam panel are not measurably decreased, so that substantially improved damping properties over roofing of other kinds that are achieved by a polyurethane hard foam panel are being fully retained.

It is especially advantageous that the polyurethane integral hard foam of the construction panel include fillers, namely 5 to 65% of aluminum hydroxide [$Al(OH)_3$], 5 to 25% of Exolite (ammonium polyphosphate) and 1 to 75% of slate powder having a wide granulometric range.

Insofar as relatively small proportions of the flame-retardant are provided, a relatively high proportion of 60 to 90% of slate powder can be used whereas for higher proportions of the flame-retardant, slate powder proportions of 30 to 60% are applicable.

The slate powder moreover can be replaced in part or in whole by boron, whereby incombustibility is further improved. Again it is possible to replace the slate powder in part or in whole by carbon in the form of soot, whereby an increase in impact strength is obtained.

Lastly, the slate powder can be replaced in part or in whole by synthetic organic fillers such as cellulose or cellulose derivatives, polystyrene, acrylonitrile-butadiene styrene (ABS), polyamide and/or polyester, where ABS also increases the impact strength, whereas polyamide or polyester is used for reinforcement.

Advantageous compositions of the construction panel are listed in the Examples below.

| INGREDIENT | % by weight |
|---|---|
| Example 1 | |
| polyurethane integral hard foam | 39 |
| aluminum hydroxide | 45 |
| Exolite 263 (Ammonium Polyphosphate) | 15 |
| slate powder and/or quartz sand and/or chalk | 1 |
| Example 2 | |
| polyurethane integral hard foam | 30 |
| aluminum hydroxide | 10 |
| Exolite 422 (Ammonium Polyphosphate) | 15 |
| slate powder and/or quartz sand and/or chalk | 45 |
| Example 3 | |
| polyurethane integral hard foam | 20 |
| aluminum hydroxide | 10 |
| Exolite 263 (Ammonium Polyphosphate) | 15 |
| slate powder and/or quartz sand and/or chalk | 55 |
| Example 4 | |
| polyurethane integral hard foam | 20 |
| aluminum hydroxide | 10 |
| Exolite 422 (Ammonium Polyphosphate) | 5 |
| slate powder and/or quartz sand and/or chalk | 65 |
| Example 5 | |
| polyurethane integral hard foam | 18 |
| aluminum hydroxide and/or Exolite 263 (Ammonium Polyphosphate) | 2 |
| slate powder and/or quartz sand and/or chalk | 80 |
| Example 6 | |
| polyurethane integral hard foam | 18 |
| aluminum hydroxide and/or Exolite 422 (Ammonium Polyphosphate) | 2 |
| slate powder | 72 |
| chalk | 8 |

The aluminum hydroxide is in the form of a white fine-grained powder with a grain size between 10 and 150 microns.

Either a DD enamel (Desmodur/Desmophen enamel), i.e., a two component enamel or a single component synthetic resin enamel are applicable for enameling the surfaces of the construction panel of the invention.

Furthermore the composition of the material for the construction panel of the invention can be used in manufacturing molded roof fittings of a different kind such as molded roof ridge connectors, molded eave parts, ventilation components, ventilation connectors, and the like.

Appropriately the fillers for the polyurethane integral hard foam consisting of two components, namely isocyanate and polyol, are fed into the more viscous polyol before the two components are mixed.

When using both enamels, advantageously the enameling will take place by the so-called IMC (in mold coating) method because it saves a separate operational step and because additionally there is the possibility of transferring the surface structure of the mold to the surface of the finished construction panel without smearing by the enamel. In the known IMC method, the enamel is deposited beforehand by spraying onto the particular foaming mold's walls, electrostatic deposition also being feasible. Another advantage of this known method is the capability of introducing release means into the enamel whereby the use of further release means between the mold and the product is eliminated.

What we claim is:

1. In a construction panel made of polyurethane integral hard foam and comprising a denser edge zone and a porous core, the construction panel surface being enameled, the improvement comprising said polyurethane integral hard foam of the construction panel including fillers, namely flame-retardants comprising 5 to 65% by weight aluminum hydroxide, and 30 to 90% by weight of slate powder with a relatively high proportion of slate powder being provided for a relatively low proportion of flame-retardants.

2. The construction of claim 1, further comprising said fillers, comprising 5 to 25% by weight of ammonium polyphosphate.

3. The construction panel of claim 2, wherein said polyurethane integral hard foam contains 60 to 90% by weight of slate powder.

4. The construction panel of claim 2, wherein said polyurethane integral hard foam contains 30 to 65% by weight of slate powder.

5. In a construction panel made of polyurethane integral hard foam and comprising a denser edge zone and a porous core, the construction panel surface being enameled, the improvement comprising said polyurethane integral hard foam of the construction panel including fillers, namely flame-regardants comprising 5 to 65% by weight aluminum hydroxide and 30 to 90% by weight of granular and fibrous materials selected from the group consisting of quartz sand, calcium carbonate, slag, glass, silicon, boron, carbon soot, cellulose, cellulose derivatives, polystyrene, acrylonitrile-butadiene-styrene, polyamide, and polyester.

6. The construction panel of claim 5, further comprising said fillers comprising 5 to 25% by weight of ammonium polyphosphate.

7. The construction panel of claim 2, wherein said construction panel consists of 30% by weight polyurethane integral hard foam, 10 percent by weight aluminum hydroxide, 15% by weight ammonium polyphosphate and 45% by weight slate powder.

8. The construction panel of claim 6, wherein said construction panel consists of 30% by weight polyurethane integral hard foam, 10% by weight aluminum hydroxide, 15% by weight ammonium polyphosphate and 45% by weight of said granular and fibrous materials.

9. The construction panel of claim 2, wherein said construction panel consists of 20% by weight polyurethane integral hard foam, 10% by weight aluminum hydroxide, 15% by weight ammonium polyphosphate, and 55% by weight slate powder.

10. The construction panel of claim 6, wherein said construction panel consists of 20% by weight polyurethane integral hard foam, 10% by weight aluminum hydroxide, 15% by weight ammonium polyphosphate and 55% by weight of said granular and fibrous materials.

11. The construction panel of claim 2, wherein said construction panel consists of 20% by weight polyurethane integral hard foam, 10% by weight aluminum hydroxide, 5% by weight ammonium polyphosphate and 65% by weight slate powder.

12. The construction panel of claim 6, wherein said construction panel consists of 20% by weight polyurethane integral hard foam, 10% by weight aluminum hydroxide, 5% by weight ammonium polyphosphate and 65% by weight of said granular and fibrous materials.

13. The construction panel of claim 2, wherein said enamel is a two component enamel.

14. The construction panel of claim 6, wherein said enamel is a two component enamel.

15. The construction panel of claim 2, wherein said enamel is a single component synthetic resin.

16. The construction panel of claim 6, wherein said enamel is a single component synthetic resin.

17. In a process for manufacturing a construction panel made of polyurethane integral foam having a denser edge zone and a porous core and an enameled panel surface, the improvement comprising:

mixing 5 to 65% by weight aluminum hydroxide, 5 to 25% by weight of ammonium polyphosphate, and 30 to 90% by weight of slate powder with polyol, adding isocyanate to the mixture, and foaming the panel.

18. The process of claim 17 wherein said enameled panel surface is achieved by in-mold coating.

* * * * *